US005411095A

United States Patent [19]

Ehlinger et al.

[11] Patent Number: 5,411,095

[45] Date of Patent: May 2, 1995

[54] APPARATUS FOR CEMENTING A CASING STRING

[75] Inventors: Jeffry C. Ehlinger, Houston; Frank Cole, Sugar Land, both of Tex.

[73] Assignee: Davis-Lynch, Inc., Houston, Tex.

[21] Appl. No.: 38,234

[22] Filed: Mar. 29, 1993

[51] Int. Cl.[6] ..... E21B 34/14; E21B 33/16

[52] U.S. Cl. ..... 166/317; 166/154; 166/318; 166/332

[58] Field of Search ..... 166/318, 317, 321, 332, 166/154, 156

[56] References Cited

U.S. PATENT DOCUMENTS 3,789,926 2/1974 Henley et al. ..... 166/318
4,674,569 6/1987 Revils et al. ..... 166/154
4,776,395 10/1988 Baker et al. ..... 166/184
5,024,273 6/1991 Coone et al. ..... 166/289

FOREIGN PATENT DOCUMENTS 702157 12/1979 U.S.S.R. ..... 166/318

OTHER PUBLICATIONS

Davis Equipment Catalog No. 10; Davis-Lynch, Inc. 1991.

*Primary Examiner*—Hoang C. Dang
*Attorney, Agent, or Firm*—Ben D. Tobor

[57] ABSTRACT

A method and apparatus for cementing a casing string utilizes a port collar which may be hydraulically opened and mechanically closed, and permits the passage of downhole tools through the port collar, without opening the port collar.

33 Claims, 6 Drawing Sheets

APPARATUS FOR CEMENTING A CASING STRING

BACKGROUND OF THE INVENTION

1. Field of the Invention

The invention relates to a method and apparatus for cementing a casing string within a well bore.

2. Description of the Prior Art

When a well for the production of hydrocarbons is drilled, it is necessary to place lengths, or strings, of pipe, or casing, in the well bore to various depths to permit the well driller to control the well while drilling operations are ongoing, as well as to allow control of the well while the hydrocarbons, or oil or gas, are being produced. These strings of pipe, or a casing string, are typically permanently installed in the well bore by cementing them to the well bore. In some instances a casing string is permanently installed, as by cementing, within a larger diameter casing string, or cased hole. As used herein, the term "well bore" means either an open, or drilled, bore hole, or a cased hole, which already has a length of casing installed therein. Typically, the strings of pipe, or casing string, are permanently installed within the well bore by pumping cement into the annular cavity between the outside of the pipe, or casing, and the well bore.

In some instances due to well conditions, the entire length of casing string cannot be cemented within the well bore along the entire length of the casing string by pumping cement outwardly from the lower end of the casing string and then upwardly along the entire length of the casing string. In these instances, a down-hole tool, such as a stage cementing collar is disposed in the casing string between its upper and lower ends, generally somewhere near the middle of the casing string. The tool is operable to permit cement to be pumped outwardly through the tool and into the annular cavity between the casing string and the well bore. Typically the tool is operated to temporarily open fluid ports in the tool, through which the cement may pass into the annular cavity. The foregoing procedure is generally known in the art as "two-stage cementing", wherein cement is mixed and pumped into the annular cavity between the casing string and the well bore from two different locations along the length of the casing string, the first location being the bottom of the casing string, and the second location being adjacent the tool having the fluid ports. There are presently a variety of tools and methods in use to accomplish two-stage cementing.

One method and apparatus for two-stage cementing involves dropping a weighted device down the casing string which lands in a sleeve in a cementing collar and seals the inner bore of the cementing collar, whereby fluid cannot pass down the casing string beyond the weighted device. Fluid pressure is applied to the cementing collar, as by pumping cement into the casing string and cementing collar. This pressure force causes the shearing of shear pins which releasably secure an opening sleeve over fluid ports extending from the interior of the cementing collar to the annular cavity between the casing string and the well bore. After the desired amount of cement has been pumped through the cementing collar, a rubber closing plug is placed in the casing string and pumped to the cementing collar until the rubber closing plug lands on another sleeve, or closing sleeve, within the cementing collar. The rubber closing plug is also disposed in a sealing relationship within the cementing collar, whereby upon the pumping of a fluid, such as drilling mud, into the casing string and cementing collar, the rubber closing plug applies a force to the closing sleeve. This force is sufficient to shear a plurality of shear pins which initially hold the closing sleeve in an open, fluid transmitting relationship with the exterior of the cementing collar. Upon the shear pins of the closing sleeve being sheared, the closing sleeve moves downwardly to seal off the fluid ports of the cementing collar.

In another method and apparatus for two-stage cementing, a cementing collar, disposed within the casing string, is opened by the application of fluid pressure acting upon an opening sleeve of the cementing collar. Shear pins, or shear balls, initially restrain the desired downward movement of the opening sleeve, until the necessary hydraulic force has been applied to the opening sleeve to shear the pins or balls. After a desired quantity of cement is pumped through the exposed fluid ports, a rubber closing plug is pumped downwardly through the casing string until it lands on another sleeve, or closing sleeve, and seats therein in a sealing relationship. By continuing to apply fluid pressure to the closing plug, shear pins, or shear balls, which initially restrain the movement of the closing sleeve, are sheared and the closing sleeve moves downwardly to seal the fluid ports in the cementing collar.

A further two-stage cementing method and apparatus utilizes a cementing tool having a plurality of fluid ports disposed within the casing string. This cementing tool has its fluid ports opened and closed by another tool which is run into the casing string on a smaller diameter string of pipe, such as production tubing. When the second tool is disposed within the cementing tool, it may operated to open or close the set of ports located in the cementing tool, typically either by rotating a sleeve within the cementing tool, or by moving a sleeve within the cementing tool either upwardly or downwardly to open and close the fluid ports.

Each of the foregoing two-stage cementing methods and apparatus have certain disadvantages associated with them, particularly when the well bore is a deviated hole, wherein the lower end of the casing string is disposed at an angle, with respect to the upper end of the casing string, which can approach 90° in the case of certain horizontally drilled wells. For example, in methods and apparatus requiring the dropping of a weighted device into the cementing collar, some times such weighted opening devices do not reach the cementing collar to perform their desired function of opening the cementing collar, because of resistance encountered from the viscous fluid, such as drilling mud, disposed in the casing string. Particularly in deviated well bores, the gravity force acting upon the weighted opening device may not be sufficient to overcome the frictional drag force of the opening device upon the interior surface of the casing string at locations where the casing string is not perpendicular to the earth's surface.

Another disadvantage associated with methods and apparatus which require weighted opening devices and/or rubber closing plugs is that after the desired cementing operation has been completed, it is then necessary to expend valuable drilling rig time to drill out the rubber closing plug and/or weighted opening device, in order to clear the interior bore of the casing string. With respect to two-stage cementing methods and apparatus which require the use of another tool lowered through the casing string to the cementing collar, particularly when the cementing collar sleeve is opened by upward or downward movement of the opening/closing tool, every time the opening/closing tool passes through the cementing collar, the fluid ports will either be automatically opened or closed. In such equipment, it is not possible to pass the opening/closing tool through the cementing collar without opening or closing the fluid ports. Thus, it is not possible with such equipment to use the opening/closing tool to perform any other functions, or operations, such as inflating a packer disposed below the cementing collar, because once the opening/-closing tool passes the cementing collar, it may automatically effect an undesired opening or closing of the fluid ports. Accordingly, another separate downhole tool must be lowered through the casing string and below the cementing collar to perform other tasks in the casing string, which tool must then be pulled out of the well bore, at which time the opening/closing tool must be attached to the smaller diameter tubing and lowered into the casing string to open or close the cementing collar. In the prior art two-stage cementing apparatus and methods which require rotation of an opening/closing tool suspended from a tubing string, it is very difficult to operate such equipment to open or close a cementing collar in a deviated well bore. Additionally, increased rig time is involved for lowering the opening/closing tool to the cementing collar.

With respect to all the foregoing prior art two-stage cementing methods and apparatus, another disadvantage associated with such equipment is that the construction of such equipment is relatively complex and expensive, and require a multitude of separate components to be assembled in order for the equipment to be operable. Another disadvantage of some prior art two-stage cementing equipment is that they utilize seals which may be in the flow-path of the cement which passes through the fluid ports, whereby a possibility exists that such seals may be eroded, or cut, by the cement flowing out of the flow port. Such erosion, or cutting, can result in well fluids leaking out of the tool which is undersireable.

Accordingly, prior to the development of the present invention, there have been no methods and apparatus for cementing a casing string which: are simple, economical, and efficient to manufacture and use; do not require weighted opening devices and/or rubber closing plugs; permit an opening/closing tool to pass through the cementing collar without always either opening or closing the fluid ports of the cementing collar; permit an opening/closing tool to perform other desired functions within the casing string disposed below the cementing collar; and utilize seals for the fluid ports which are not in the flow path of the cement passing through the fluid ports.

Therefore, the art has sought methods and apparatus for cementing a casing string in a well bore which: are simple, economical and efficient to manufacture and use; do not require the use of weighted opening devices and/or rubber closing plugs; permit an opening/closing tool to pass through the cementing tool without always either opening or closing the cementing tools; permit an opening/closing tool to also be used to perform additional functions and tasks in the casing string below the cementing tool; and utilize seals which are not in the flow-path of the cement which passes through the fluid ports.

SUMMARY OF THE INVENTION

In accordance with the invention, the foregoing advantages have been achieved through the present method for cementing a casing string, having an upper and lower end and a first diameter, within a well bore having an annular cavity disposed between the casing string and the well bore. The present invention includes the steps of: lowering the casing string within the well bore, with a port collar disposed in the casing string, at a location between the upper and lower ends of the casing string; pumping a first quantity of cement through the lower end of the casing string into the annular cavity; preventing the passage of additional cement from passing through the lower end of the casing string; lowering a length of pipe, having a second diameter which is smaller than the first diameter of the casing string, until a portion of the length of pipe is adjacent the port collar; sealing the portion of the length of pipe against the port collar and providing a fluid communication passageway between the length of pipe and the port collar; pumping a quantity of drilling mud into the length of pipe to apply a first predetermined hydraulic force to open the port collar to provide a first fluid communication passageway between the port collar and the annular cavity; pumping a second quantity of cement through the length of pipe and the fluid communication passageways into the annular cavity; and moving the length of pipe to apply a second predetermined force to the port collar to close the first fluid communication passageway.

A further feature of the present invention is that the fluid communication passageway between the port collar and the annular cavity may be closed by moving the length of pipe longitudinally with respect to the port collar, with a port collar engaging means, disposed on the portion of the length of pipe, engaging a movable sleeve of the port collar to apply the second predetermined force, in a longitudinal direction with respect to the port collar, upon the port collar. Another feature of the present invention may include the step of mechanically locking the movable sleeve in a closed position, whereby the fluid communication passageway between the port collar and the annular cavity may not be opened again.

A further feature of the present invention is that the first predetermined force to open the port collar is greater than the second predetermined force applied by the portion of the length of pipe. An additional feature of the present invention may include the step of releasably securing a movable sleeve within the port collar, which movable sleeve requires the application of the first predetermined hydraulic force to move the sleeve to open the port collar to provide the fluid communication passageway between the port collar and the annular cavity. Another feature of the present invention is that the first predetermined hydraulic force to open the port collar is greater than the second predetermined force applied by the portion of the length of pipe, whereby before the port collar has been opened, the portion of the length of pipe may be repeatedly passed upwardly and downwardly through the port collar without opening the port collar.

Another feature of the present invention may include the step of utilizing as the portion of the pipe, a swab cup wash tool to provide the fluid communication passageway between the length of pipe and the port collar; and performing other functions with the swab cup wash tool at locations between the port collar and the lower end of the casing string. An additional feature of the present invention includes the step of not disposing and utilizing a closure member within the port collar to open or close the fluid communication passageway between the port collar and the annular cavity, which closure member must be drilled out to gain access to locations within the casing string between the port collar and the lower end of the casing string.

In accordance with another aspect of the invention, the foregoing advantages have been achieved through the present port collar for cementing a casing string having an upper and lower end within a well bore. This aspect of the present invention includes: an outer, generally tubular-shaped barrel having an inner and an outer surface with at least one fluid port disposed between and through the inner and outer surfaces of the barrel; means for connecting the barrel to the casing string at a location intermediate the upper and lower ends of the casing string; a movable, generally tubular-shaped sleeve, having an inner bore and an outer surface, disposed within the barrel with the outer surface of the sleeve in a sealed relationship with the inner surface of the barrel, the sleeve having at least one fluid port extending between and through the inner bore and outer surface of the sleeve; a first means for releasably securing the sleeve within the barrel in a first position with the at least one fluid ports of the barrel and sleeve being longitudinally spaced from each other, whereby cement may not pass from the inner bore of the sleeve through the at least one fluid port of the barrel, the first releasable securing means requiring an application of a first predetermined hydraulic force upon the sleeve to release the sleeve and permit the sleeve to move in a first direction, longitudinally with respect to the barrel to a second position with the at least one fluid ports of the sleeve and the barrel in a mating, fluid communication relationship, whereby cement may be passed from the inner bore of the sleeve and through the fluid ports into the well bore; the sleeve requiring an application of a second predetermined force, which is less than the first predetermined force, to move the sleeve and permit the sleeve to move in a second direction, opposite from the first direction of sleeve movement, longitudinally with respect to the barrel; and means for locking the sleeve within the barrel in a third position with the at least one fluid ports of the barrel and sleeve being longitudinally spaced from each other, whereby cement may not pass from the inner bore of the sleeve through the at least one fluid port of the barrel.

Another feature of the present invention is that a first portion of the outer surface of the sleeve may have a first diameter and a second portion of the outer surface of the sleeve may have a second diameter, the first diameter being greater than the second diameter; and a first portion of the inner surface of the barrel has a first diameter, substantially corresponding in size to the first diameter of the sleeve, and a second portion of the inner surface of the barrel has a second diameter substantially corresponding in size to the second diameter of the sleeve, whereby upon the application of the first predetermined hydraulic force upon the sleeve, the sleeve will move in a longitudinal direction with respect to the barrel toward the smaller diameter of the sleeve and barrel.

An additional feature of the present invention includes a second means for releasably securing the sleeve within the barrel in the second position, the second predetermined force acting upon the sleeve to release the sleeve and permit the sleeve to move in the second direction; and the second releasable securing means is a snap ring disposed in a second mating groove defined by a second annular groove formed in the outer surface of the sleeve in a second annular groove formed in the inner surface of the barrel. A further feature of the present invention is that the inner bore of the sleeve may include a means for receiving a port collar engaging means which applies a second predetermined force to move the sleeve into the third position, and the receiving means may be an annular groove formed in the inner bore of the sleeve which substantially mates with the port collar engaging means.

In accordance with another aspect of the invention, the foregoing advantages have been achieved through the present cementing apparatus for cementing a casing string having an upper and lower end within a well bore. This aspect of the present invention includes: an outer, generally tubular-shaped barrel having an inner and an outer surface with at least one fluid port disposed between and through the inner and outer surfaces of the barrel; means for connecting the barrel to the casing string at a location intermediate the upper and lower ends of the casing string; a movable, generally tubular shaped sleeve, having an inner bore and an outer surface, disposed within the barrel with the outer surface of the sleeve in a sealed relationship with the inner surface of the barrel, the sleeve having at least one fluid port extending between and through the inner bore and outer surface of the sleeve; a first means for releasably securing the sleeve within the barrel in a first position with the at least one fluid ports of the barrel and sleeve being longitudinally spaced from each other, whereby cement may not pass from the inner bore of the sleeve through the at least one fluid port of the barrel, the first releasable securing means requiring an application of a first predetermined hydraulic force upon the sleeve to release the sleeve and permit the sleeve to move in a first direction, longitudinally with respect to the barrel to a second position with the at least one fluid ports of the sleeve and the barrel in a mating, fluid communication relationship, whereby cement may pass from the inner bore of the sleeve and through the fluid ports into the well bore; the sleeve requiring an application of a second predetermined force, which is less than the first predetermined force, to move the sleeve and permit the sleeve to move in a second direction, opposite from the first direction of sleeve movement, longitudinally with respect to the barrel; means for locking the sleeve within the barrel in a third position with the at least one fluid ports of the barrel and sleeve being longitudinally spaced from each other, whereby cement may not pass from the inner bore of the sleeve through the at least one fluid port of the barrel; and a swab cup wash tool having a port collar engaging means and a plurality of longitudinally spaced swab cups for sealing engagement with the inner bore of the port collar when the sleeve is in the second position, the port collar engaging means cooperating with the inner bore of the sleeve to apply the second predetermined force to move the sleeve.

The method and apparatus for cementing a casing string of the present invention, when compared with previously proposed prior art methods and apparatus, have the advantages of: being simple, economical, and efficient to manufacture and use, do not require the use of a weighted opening device and/or rubber closing plug; permit a tool which can close the fluid ports to be passed through the port collar to perform other functions below the port collar in the casing string, without opening the port collar; and utilize seals which are not in the flowpath of the cement which passes through the fluid ports.

BRIEF DESCRIPTION OF THE DRAWINGS

FIGS. 6A1, 6A2 and 6B are a partial cross-sectional views of the upper and lower ends of the swab cup wash tool of FIG. 4 disposed within the port collar of FIG. 2;

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

Figure 1:
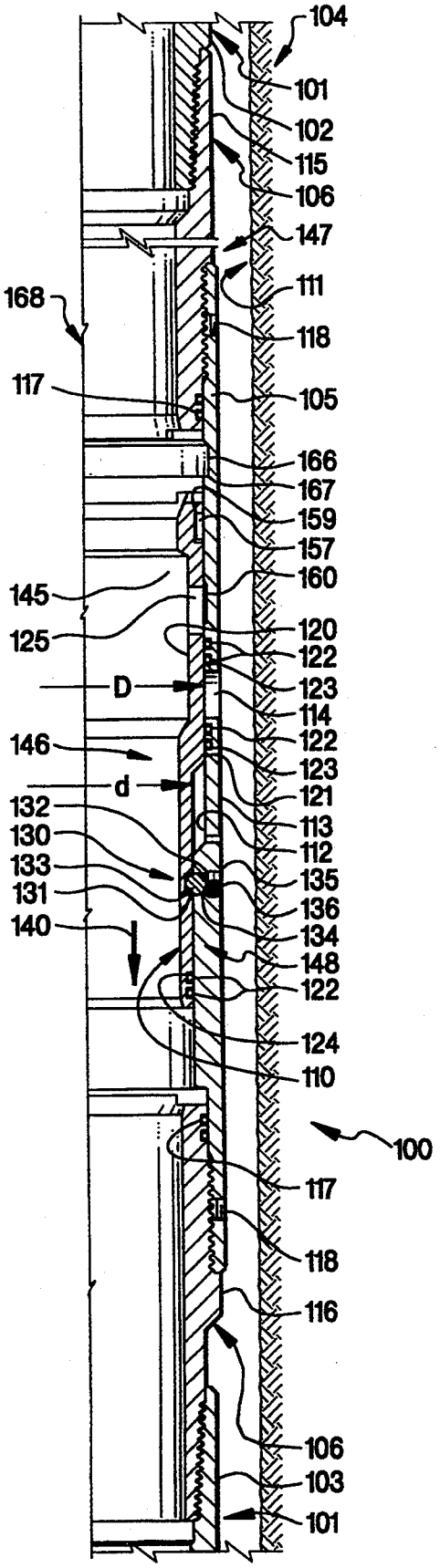
FIG. 1 is a partial cross-sectional view of the port collar in accordance with the present invention disposed in a well bore, the port collar being illustrated in its first, closed position.

With reference to FIG. 1, a port collar 100, for cementing a casing string 101 having upper and lower ends 102, 103, within a well bore 104 is shown as including an outer, generally tubular-shaped barrel 105, means for connecting 106 the barrel 105 to the casing string 101 at a location intermediate the upper and lower ends 102, 103 of casing string 101, and a movable, generally tubular shaped sleeve 110 disposed within the barrel 105. Well bore 104 is illustrated as being an open hole, or open bore hole, having an annular cavity 111 disposed between the casing string 101 and port collar 100, and the well bore 104. The use of the term "well bore" also encompasses a cased hole, wherein it is desired to cement casing string 101 within a larger diameter casing string (not shown) which has already been cemented within an open hole, or within another previously installed casing string, as is conventional in the art. Further, the use of the term "cement" also encompasses any type of cement, as well as other completion and/or well bore fluids which are desired to be pumped outwardly through port collar 100. Well bore 104 may be a conventionally drilled open hole which is disposed substantially perpendicular to the earth's surface (not shown), or may be a deviated well bore, wherein the lower end 103 of the casing string 101 may be disposed at an angle with respect to the upper end 102 of the casing string 101, which angle can approach 90° in the case of certain horizontally drilled wells. As is conventional in the art, the lower end 103 of casing string 101 may be provided with any suitable means, such as a float collar or float shoe (not shown) disposed at the lowermost end of casing string 101, through which a first quantity of cement may be pumped through the lower end 103 of casing string 101 and outwardly into the annular cavity 111 of well bore 104. Port collar 100 is utilized to provide another cement outlet disposed at a location intermediate the upper and lower ends 102, 103 of casing string 101.

Still with reference to FIG. 1, barrel 105 has an inner and outer surface 112, 113 with at least one fluid port 114 disposed between and through the inner and outer surfaces 112, 113 of barrel 105. The connection means 106 for connecting the barrel 105 to the casing string 101 preferably includes a top sub 115 and a bottom sub 116 which are threadedly received by barrel 105 in a conventional manner. A plurality of conventional seals 117 may be used in connection with top and bottom subs 115, 116, to insure a fluid tight seal between top and bottom subs 115, 116, and barrel 105. One or more set screws (not shown) may be passed through threaded openings 118 in barrel 105 to fixedly secure the top and bottom subs 115, 116 to barrel 105. The upper end 102 of casing string 101 is threadedly received within top sub 115 in a conventional manner, and the lower end 103 of casing string 101 may also be threadedly disposed upon bottom sub 116 in a conventional manner. Sleeve 110 has an inner bore surface, or inner bore, 120 and an outer surface 121, and the outer surface 121 of sleeve 110 is disposed in a sealed relationship with the inner surface 112 of barrel 105, as by a plurality of conventional static seals 122 disposed in annular grooves 123 formed in the inner surface 112 of barrel 105, or annular grooves 124 formed in the outer surface 121 of sleeve 110. Sleeve 110 has at least one fluid port 125 extending between and through the inner bore 120 and outer surface 121 of sleeve 110. Preferably four fluid ports 125 are formed in sleeve 110, and barrel 105 is also provided with four fluid ports 114, which ports 114,125, as will hereinafter be described are caused to be disposed in a mating, fluid communication relationship to permit the passage of cement (not shown) from passing through the inner bore 120 of sleeve 110 and through barrel 105 to annular cavity 111.

Still with reference to FIG. 1, port collar 100 has a first means for releasably securing 130 the sleeve 110 within barrel 105 in a first position, or closed position, with the at least one fluid ports 114, 125 of the barrel 105 and sleeve 110 being longitudinally spaced from each other along the longitudinal axis 168 of casing string 101, whereby cement (not shown) may not pass from the inner bore 120 of the sleeve 110 to the at least one fluid port 114 of the barrel 105 and into annular cavity 111. Preferably first releasable securing means 130 is a plurality of metallic balls 131, such as brass balls, disposed in a first mating groove 132 which is defined by a first annular groove 133 formed in the outer surface 121 of sleeve 110, and a first annular groove 134 formed in the inner surface 112 of barrel 105. Balls 131 could of course be made of any suitable metallic or plastic material, provided it has the necessary strength characteristics for use in a downhole environment, as well as can be sheared as hereinafter described.

Figure 2:
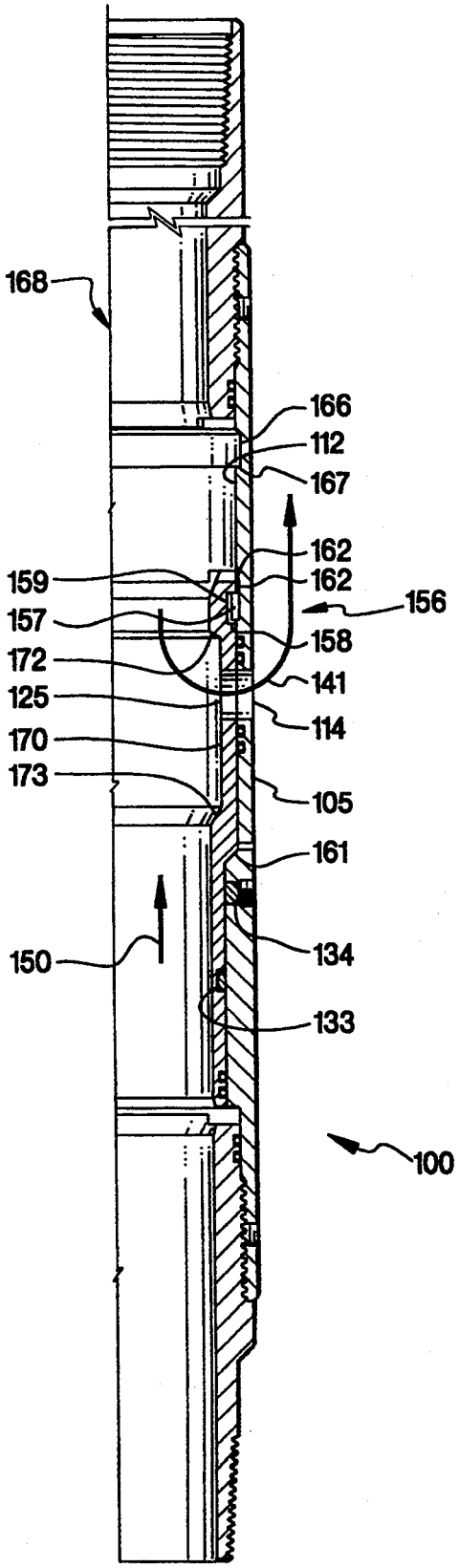
FIG. 2 is a partial cross-sectional view of the port collar of FIG. 1, in accordance with the present invention, being illustrated in its second, open position.

In assembling port collar 100, sleeve 110 is disposed within barrel 105 in the configuration illustrated in FIG. 1, wherein first annular grooves 133, 134 of sleeve 110 and barrel 105 are in a mating relationship, and the plurality of balls 131 are passed through an opening 135 in barrel 105 until they fall into the first mating groove 132. A conventional plug 136 seals opening 135. First releasable securing means 130 requires the application of a first predetermined force upon the sleeve 110 to release the sleeve 110 and permit the sleeve to move in a first direction, longitudinally with respect to the barrel 105 to a second position, as will be hereinafter described in greater detail. Upon the application of a suitable force in the direction shown by arrow 140 upon sleeve 110, sleeve 110 will also move in the direction of arrow 140. Sleeve 110 thus exerts a force upon the brass balls 131, until the brass balls 131 are sheared in half, and sleeve 110 continues to move in the first direction as shown by arrow 140 until it is disposed in a second position, as illustrated in FIG. 2. The at least one fluid ports 125, 114 of the sleeve 110 and barrel 105 are then in a mating, fluid communication relationship, whereby cement (not shown) may pass from the inner bore 120 of sleeve 110 and through the fluid ports 125, 114 into the annular cavity 111 of well bore 104 in the direction of arrow 141 (FIG. 2). As seen in FIG. 2, half of each brass ball 131 remains in first annular grooves 133, 134 of sleeve 110 and barrel 105.

Still with reference to FIG. 1, a first portion 145 of the outer surface 121 of the sleeve 110 has a first diameter D and a second portion 146 of the outer surface 121 of the sleeve 110 as a second diameter d, the first diameter D being greater than the second diameter d. Similarly, a first portion 147 of the inner surface 112 of the barrel 105 has a first diameter D, substantially corresponding in size to the first diameter D of the sleeve 110, and a second portion 148 of the inner surface 112 of the barrel 105 has a second diameter d substantially corresponding in size to the second diameter d of the sleeve 110. Because of this configuration and the sealed relationship between sleeve 110 and barrel 105, sleeve 110 acts as a piston having a differential piston area within barrel 105. Upon the application of a hydraulic force, such as high pressure drilling mud passing through the inner bore 120 of sleeve 110 as will be hereinafter described in greater detail, the resulting force upon sleeve 110 causes the sleeve 110 to move in a longitudinal direction with respect to the barrel 105 toward the smaller diameter d portions 146, 148 of the sleeve 110 and barrel 105, or in the direction of arrow 140. As also seen in FIG. 1, the first annular grooves 133, 134 of the sleeve 110 and barrel 105, which form a part of the first releasable securing means 130 are disposed on the reduced diameter portions 146, 148 of the sleeve 110 and barrel 105.

Figure 3:
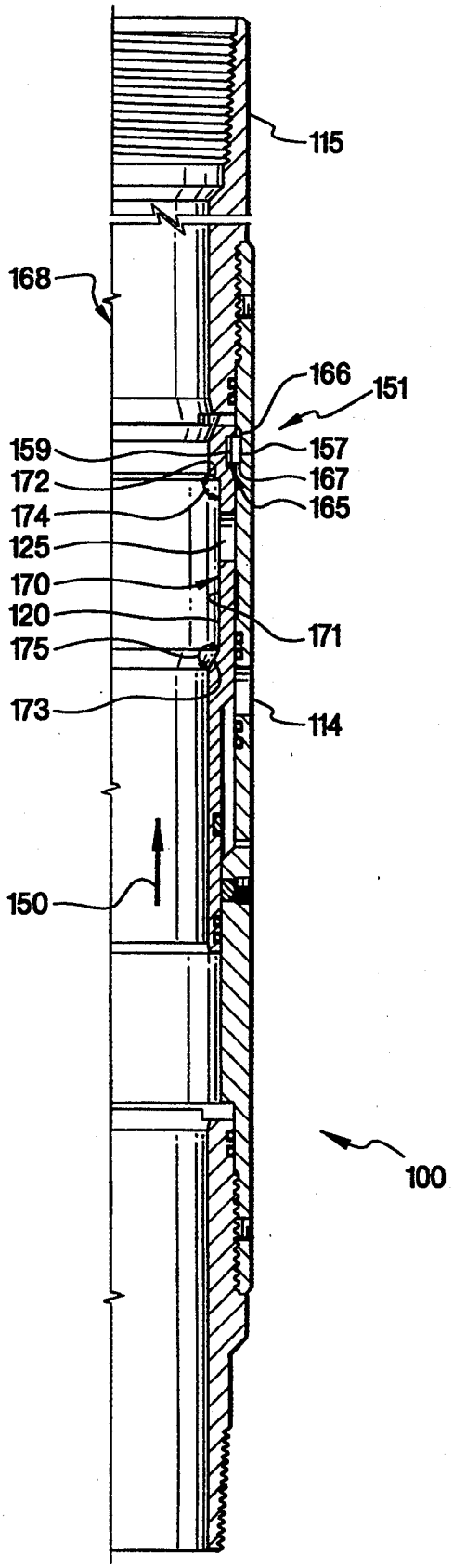
FIG. 3 is a partial cross-sectional view of the port collar of FIG. 1, in accordance with the present invention, with the port collar being illustrated in its third, locked and closed position.

With reference to FIG. 2, after the first predetermined force has been applied to sleeve 110 which causes the shearing of balls 131 of first releasable securing means 130, the sleeve 110 is disposed within barrel 105 in the second position, or open position, illustrated in FIG. 2. When port collar 100 is disposed in the second position, cement may be pumped outwardly from inner bore 120 of sleeve 110 into the annular cavity 111 between casing string 101 and well bore 104. After the desired quantity of cement has been pumped outwardly through ports 114 and 125, it is then necessary to seal ports 114, to prevent further passage of cement into annular cavity 111. A second predetermined force, which is less than the first predetermined force necessary to shear balls 131 of first releasable securing means 130, must be applied to sleeve 110 to move sleeve 110 and permit the sleeve to move in a second direction, in the direction of arrow 150, opposite from the first direction of sleeve movement, as shown by arrow 140. Sleeve 110 will then be disposed in a third position with the at least one fluid ports 114, 125 of the barrel 105 and sleeve 110 being once again longitudinally spaced from each other, as illustrated in FIG. 3. With the sleeve 110 in the third position illustrated in FIG. 3, cement may not pass from the inner bore 120 of the sleeve 110 through the at least one fluid port 114 of barrel 105. Preferably, port collar 100 includes a means for locking 151 the sleeve 110 within the barrel 105 in the third position illustrated in FIG. 3. By locking sleeve 110 in the third closed position illustrated in FIG. 3, cement previously pumped outwardly of fluid ports 114 cannot reenter the casing string 101, nor can fluid contained within casing string 101 pass outwardly through fluid ports 114, which could prevent the proper curing of the cement disposed in the annular cavity 111.

Still with reference to FIGS. 2 and 3, port collar 100 may be provided with a second means for releasably securing 156 the sleeve 110 within the barrel 105 in the second open position illustrated in FIG. 2. The second releasable securing means 156 may be a snap ring 157 disposed in a second mating groove 158 defined by a second annular groove 159 formed in the outer surface 121 of the sleeve 110 and a second annular groove 160 formed in the inner surface 112 of barrel 105. The second annular grooves 159, 160 are preferably disposed on the enlarged diameter portions 145, 147 of sleeve 110 and barrel 105. As seen in FIG. 1, snap ring 157 is initially disposed in groove 159 in its compressed state in frictional engagement with the inner wall surface 112 of barrel 105. As sleeve 110 moves in the direction of arrow 140, snap ring 157 expands outwardly to enter the second annular groove 160 in barrel 105. Further movement of sleeve 110 in the direction of arrow 140 is prohibited because of the abutting relationship of snap ring 157 against the end of groove 160, as well as because of the abutting nature of sleeve 110 against barrel 105 as at location 161, where the diameter of the inner surface 112 of barrel 105 begins to taper toward its smaller diameter portion 148.

Still with reference to FIGS. 2 and 3, upon the application of a second predetermined force upon sleeve 110 in the direction of arrow 150, as will be hereinafter described in greater detail, sleeve 110 begins to move in the direction of arrow 150. Upon snap ring 157 engaging the tapered end wall surface 162 of groove 160, snap ring 157 is again compressed within second annular groove 159 and again assumes the configuration it had as illustrated in FIG. 1. Upon further movement of sleeve 110 in the direction of arrow 150, sleeve 110 is disposed within barrel 105 in the closed and locked configuration illustrated in FIG. 3, and is then locked into the configuration illustrated in FIG. 3 by locking means 151. Locking means 151 preferably includes snap ring 157 disposed in a third mating groove 165 defined by the second annular groove 159 formed in the outer surface 121 of sleeve 110 and a third annular groove 166 formed in the inner surface 112 of barrel 105. Further upward movement of sleeve 110 in the direction of arrow 150 is prevented by sleeve 110 abutting against top sub 115, and movement in a direction opposite to that shown by arrow 150 is prevented by snap ring 157, in its expanded condition, abutting against end wall 167 of groove 166, end wall 167 being disposed substantially perpendicular to the longitudinal axis 168 of port collar 100.

With reference to FIG. 3, the inner bore surface 120 of sleeve 110 preferably includes a means for receiving 170 a port collar engaging means 181 (FIGS. 4 and 5) to be hereinafter described in greater detail, the port collar engaging means 181 serving to apply the second predetermined force to sleeve 110 in the direction of arrow 150 to move the sleeve 110 into the closed, locked third position illustrated in FIG. 3. Receiving means 170 is preferably an annular groove 171 formed in the inner bore surface 120 of sleeve 110, which substantially mates with the port collar engaging means 181, as will be hereinafter described in greater detail. Annular groove 171 has first and second end wall surfaces 172, 173, each end wall surface 172,173 being disposed at an angle with respect to the inner bore surface 120 of the sleeve 110. Preferably the angle 174 (shown in dotted lines) of the first end wall surface 172 is different from the angle 175 (shown in dotted lines) of the second end wall surface 173 of groove 171. Preferably, angle 175 is greater than angle 174, whereby second end wall surface 173 has a gentler slope toward the inner bore surface 120 of sleeve 110 than the first end wall surface 172 of groove 171.

Figure 4A:
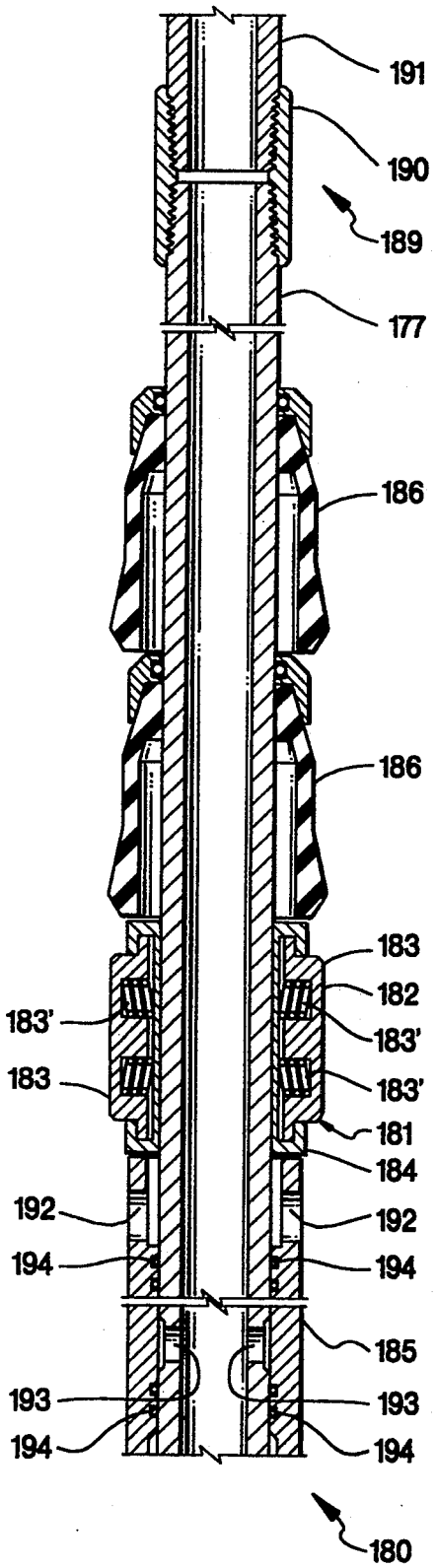
FIGS. 4A and 4B are a cross-sectional view of a swab cup wash tool which forms a part of the cementing apparatus of the present invention.
Figure 4B:
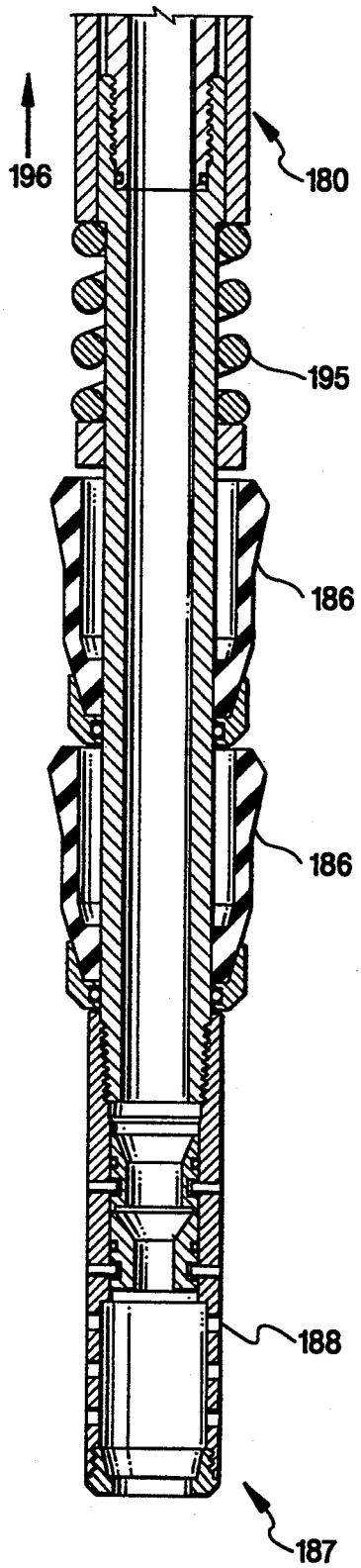

With reference to FIG. 4, a swab cup wash tool 180 is illustrated, and swab cup wash tool 180 forms a part of the cementing apparatus of the present invention which includes port collar 100 and swab cup wash tool 180. Swab cup Wash tool 180 is of conventional construction and includes a collet locator 182, which as hereinafter described in greater detail serves as the port collar engaging means 181. Collet locator 182 is slidably mounted upon an inner mandrel 177, and includes a plurality of spring biased collets 183 disposed within a tubular housing 184. Swab cup wash tool 180 has an outer tubular housing 185 which is also slidably received upon inner mandrel 177. A plurality of swab cups 186 of conventional construction are also slidably disposed upon inner mandrel 177. At the lower end 187 of swab cup wash tool 180 is disposed a conventional double bypass ball seat valve 188, which is fixedly secured to inner mandrel 177. The upper end 189 of tool 180 includes a threaded box connection 190 adapted for connecting swab cup wash tool 180 to a length of pipe, 191, which typically is a conventional production tubing string. Outer tubular housing 185 includes a plurality of wash ports 192, and inner mandrel 177 is also provided with a plurality of wash ports 193. Conventional seals 194 insure that outer tubular housing 185 is sealingly received about inner mandrel 177. A spring 195 is disposed about inner mandrel 177 in an abutting relationship with outer tubular housing 185. Upon collet locator 182 being held stationary, an upward force upon inner mandrel 177 causes spring 195 to be compressed as inner mandrel 177 is pulled upwardly in the direction of arrow 196, wherein fluid ports 192, 193, may be disposed in a fluid transmitting relationship with each other, as will be hereinafter described in greater detail. Preferably, swab cup wash tool 180 is utilized in the cementing apparatus of the present invention to apply the second predetermined force to sleeve 110 of port collar 100 to cause it to move in the direction of arrow 150, and cause sleeve 110 to be disposed in the locked and closed third position illustrated in FIG. 3.

With reference to FIGS. 1, 5, 6A and 6B, the method for cementing a casing string in accordance with the present invention and the method of operation of the cementing apparatus of the present invention will be described. When it is desired to cement a casing string 101 within a well bore 104, the casing string 101 is lowered within the well bore with port collar 100 disposed in the casing string 101 at a location between the upper and lower ends 102, 103 of the casing string as illustrated in FIG. 1. The use of the term "lowering" also encompasses the lowering of the casing string into a deviated well bore, wherein a portion of the lower end of the casing string might be passed to the bottom of the well bore along a horizontal path. As previously described, the lowermost end 103 of casing string 101 is provided with a conventional float shoe or float collar (not shown) through which a first quantity of cement may be pumped through the lower end 103 of casing string 101 into annular cavity 111. During this pumping step, port collar 100 has the configuration illustrated in FIG. 1, wherein sleeve 110 is disposed within barrel 105 with first releasable securing means 130 securing sleeve 110, whereby fluid ports 125, 114 of sleeve 110 and barrel 105 are longitudinally spaced from each other in the first closed position, whereby no cement may pass outwardly through port collar 100.

After the desired quantity of cement has been passed through the lower end 103 of casing string 101, as by through a conventional float shoe or float collar, the passage of additional cement through the lower end 103 of casing string 101 is prevented in a conventional manner, such as by pumping a conventional rubber plug with drilling mud behind the rubber plug to force it to the lower most end of casing string 101 to seal off the float shoe or float collar. If it is then desired to pump an additional quantity of cement through port collar 100 into annular cavity 111, it is then necessary to cause port collar 100 to assume its second open position as illustrated in FIG. 2. It is possible to cause the fluid ports 125, 114 of sleeve 110 and barrel 105 to be disposed in their fluid communication relationship, as illustrated in FIG. 2, by applying a first predetermined hydraulic force to open port collar 100, as by continuing to pump a quantity of fluid, such as drilling mud, any drilling fluid, any completion fluid, or water into casing string 101. The fluid exerts a hydraulic force upon sleeve 110, which because of its differential piston area, as previously described, the drilling mud forces sleeve 110 to move downwardly in the direction of arrow 140 and to shear the shear balls 131 of first releasable securing means 130. As an example, the first predetermined force necessary to be applied to sleeve 110 to cause the shearing of balls 131 may be on the order of 10,000 lbs., which force can be readily obtained from the pumping of drilling mud into port collar 100. Alternatively and preferably, the first predetermined hydraulic force is applied to sleeve 110 of port collar 100 by use of the swab cup wash tool 180. Swab cup wash tool 180 is lowered into casing string 101 by suspending it from a length of smaller diameter pipe 191, such as production tubing, until swab cup wash tool 180 is disposed within port collar 100 and casing string 101 in the configuration illustrated in FIGS. 6A and 6B.

Figures 1, 6A:
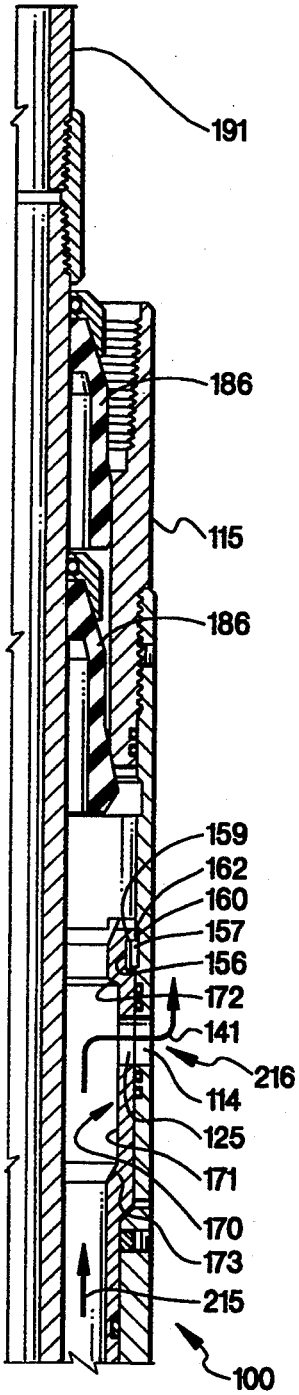
Figures 2, 6A:
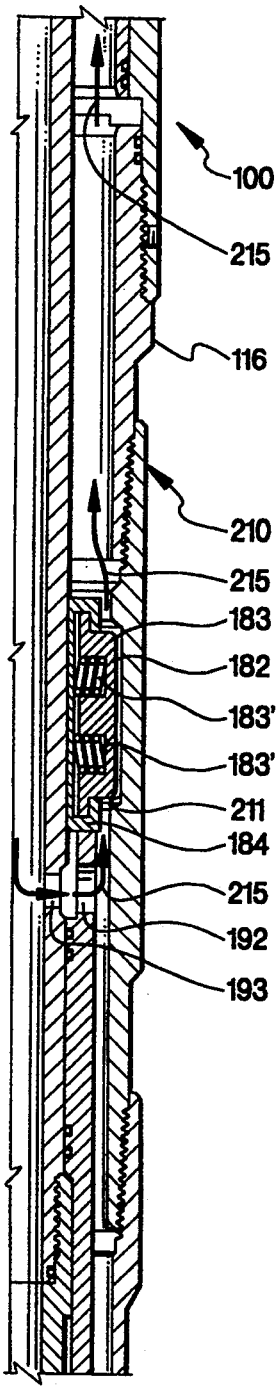
Figure 6B:
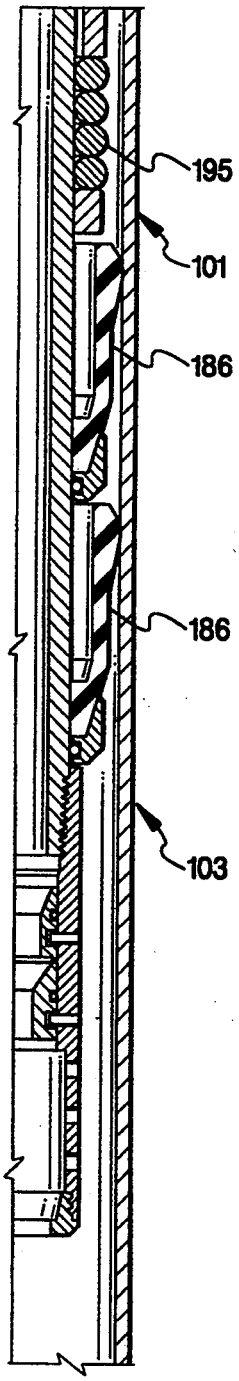

As shown in FIGS. 6A and 6B, the bottom sub 116 of port collar 118 is connected to a conventional locator sub 210 which has an internal annular groove 211 which received the plurality of collets 183 of collet locator 182, whereby swab cup wash tool 180 is releasably secured within port collar 100 and casing string 101 by locator sub 210. It should be noted that as swab cup wash tool 180 passes downwardly through port collar 100, spring biased collets 183 of collet locator 182 would first move outwardly with respect to collet housing 184 from the force exerted upon them by springs 183' into groove 170 on the inner bore surface 120 of sleeve 110. However, as swab cup wash tool 180 is further lowered downwardly through port collar 100, the plurality of collets 183 would be forced to retract upon contacting the tapered end wall surface 173 of groove 170 and would not move sleeve 110 downwardly in the direction of arrow 140 (FIG. 1) for the following reasons. The spring biased collets 183 of collet locator 182 require a force to compress collets 183 inwardly which is on the order of 5,000 pounds, which force is less than the first predetermined force of approximately 10,000 pounds necessary to cause the shearing of shear balls 133 of first releasable securing means 130. Accordingly, with port collar 100 installed in casing string 101 in its initial configuration of FIG. 1, collet locator 182 cannot apply a force to sleeve 110 which is greater than the first predetermined force necessary to cause the shearing of balls 131, whereby swab cup wash tool 180 may be lowered through port collar 100 until collet locator 182 is seated within groove 211 of locator sub 210 as illustrated in FIGS. 6A and 6B.

After collet locator 182 is seated in groove 211 of locator sub 210, an upward force is applied to the swab cup wash tool 180 via pipe string 191 to cause spring 195 of the swab cup wash tool 180 to be compressed and force wash ports 192, 193 of swab cup wash tool 180 to be disposed in a mating fluid communicating relationship as shown in FIG. 6A. At the same time, wash cups 186 are disposed in a sealing relationship with the port collar 100 in the general location of the top sub 115, as shown in FIG. 6A, and in a sealing relationship with casing string 101, as shown in FIG. 6B. Upon pumping a quantity of any suitable fluid, such as drilling mud, through pipe string 191 and into swab cup wash tool 180, the drilling mud passes outwardly through wash ports 193,192 in the direction of arrow 215 into the annular space defined by wash cups 186 and the interior of port collar 100. The pumping of drilling mud within such cavity applies the first predetermined hydraulic force sufficient to cause the movement of sleeve 110 and the resulting shearing of shear balls 131 of first releasable securing means 130. Sleeve 110 is caused to move from its first position, as illustrated in FIG. 1, to its second position illustrated in FIGS. 2 and 6A, wherein a first fluid communication passageway 216, defined by the mating fluid ports 125, 114, is provided between the port collar 100 and the annular cavity 111 with flow in the direction of arrow 141.

Still with reference to FIGS. 6A and 6B, upon the first fluid communication passageway 216 being provided as shown in FIG. 6A, a second quantity of cement is pumped through pipe string 191, or production tubing, and into swab cup wash tool 180 where it exits through wash ports 192, 193 and then flows outwardly through the first fluid communication passageway 216 into annular cavity 111. After a desired quantity of cement has been pumped through port collar 100, it is then necessary to close the first fluid communication passageway 216 by applying the second predetermined force to sleeve 110 to cause it to move in the direction of arrow 150 (FIG. 2) to cause sleeve 110 to be disposed in its final locked and closed configuration as shown in FIG. 3. While the cement pumping operation is being carried out, sleeve 110 may be releasably secured with respect to barrel 105 in its second open position by the second releasable securing means 156 as previously described. To apply the second predetermined force upon sleeve 110, the pipe string 191 is moved upwardly with a sufficient force to cause collets 183 to be compressed inwardly as swab cup wash tool 180 moves upwardly within locator sub 210 until collets 183 of collet locator 182 expand outwardly within groove 171 of receiving means 170 as illustrated in FIG. 5.

Figure 5A:
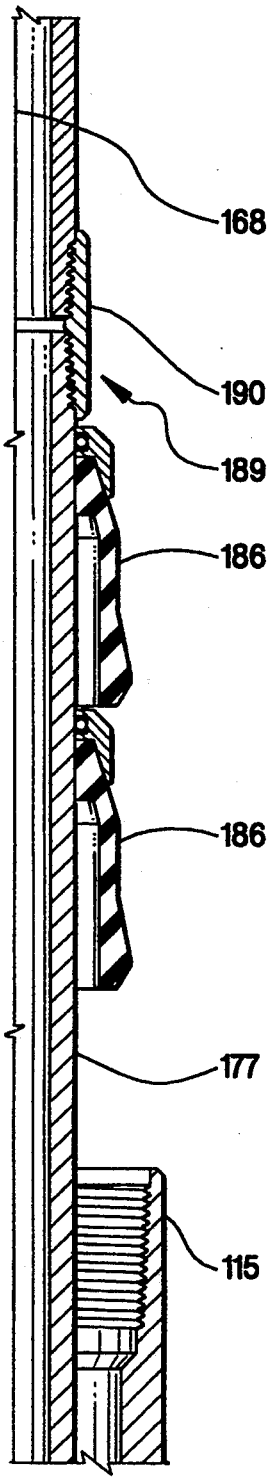
FIGS. 5A and 5B are a partial cross-sectional view of the swab cup wash tool of FIGS. 4A and 4B disclosed within the port collar of FIG. 3.
Figure 5B:
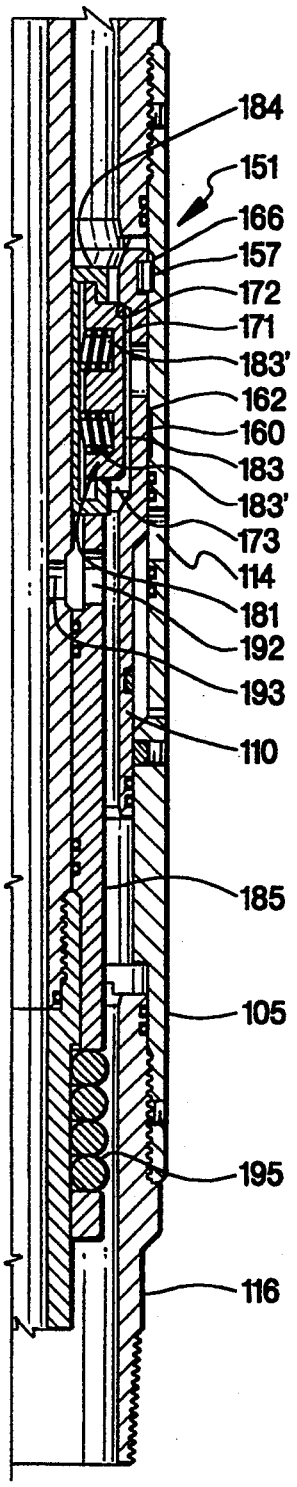

With reference to FIGS. 5 and 6A, as collets 183 spring outwardly into mating engagement with groove 171, further upward movement of sleeve 110 is initially restrained by the second releasable securing means 156, or snap ring 157 abutting tapered end wall surface 162 of groove 160, and by collets 183 abutting against end wall surface 172 of groove 171. The force required to cause snap ring 157 to compress inwardly into groove 159 is less than the force exerted upon sleeve 110 by collets 183 abutting against end wall surface 172 of groove 171. Continued upward movement of pipe string 191 and swab cup wash tool 180 causes collets 183 of collet locator 182 to remain within groove 171 of sleeve 110 while snap ring 157 is compressed and sleeve 110 is continued to be pulled upwardly. Sleeve 110 is then disposed in its final, locked third position as illustrated in FIGS. 3 and 5, wherein snap ring 157 has expanded outwardly into the third annular groove 166 of barrel 105. Because of the sleeve 110 being in an abutting relationship with top sub 115, swab cup wash tool 180 may be pulled upwardly and out of port collar 100, provided that more than a 5,000 pound upward force is exerted to cause the springs 183' of collet locator 182 to be compressed as collets 183 engage and abut against end wall surface 172 of groove 171.

It should be noted that if subsequent operations are desired to be conducted within casing string 101 with swab cup wash tool 180 at a location below port collar 100, because of the gentler slope of end wall surface 173 of groove 171, swab cup wash tool 180 may be passed downwardly through port collar 100 without causing undesired downward movement of sleeve 110. The force exerted by collet locator 182 upon sleeve 171, while it is locked in place by snap ring 157 is not sufficient to cause snap ring 157 to be compressed inwardly, whereby swab cup wash tool 180 may be repeatedly moved upwardly and downwardly through port collar 100 when it is disposed in its third locked position illustrated in FIGS. 3 and 5. Similarly, it should be noted that when port collar 100 is initially disposed within well bore 104 in its first closed position as illustrated in FIG. 1, swab cup wash tool 180 may also be repeatedly passed upward and downwardly through port collar 100 without opening port collar 100 because the force exerted by port collar engaging means 181, or collet locator 182, upon sleeve 110 is not sufficient to overcome the restraining force exerted by first releasable securing means 130 upon sleeve 110. Accordingly, with port collar 100 disposed in the casing string 101 as illustrated in FIG. 1, swab cup wash tool 180 may be utilized to perform other functions at locations below port collar 100, such as to inflate packers disposed below port collar 100, without port collar engaging means 181, or collet locator 182, opening port collar 100 by moving sleeve 110.

Figure 9:
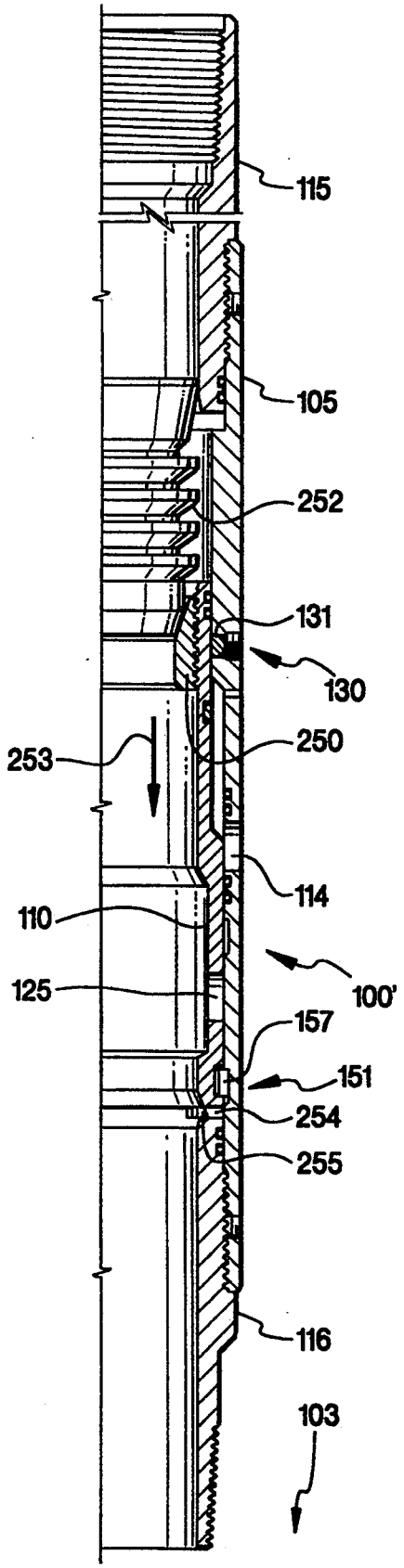
FIG. 9 is a partial cross-sectional view of the port collar of FIG. 7 in its third, locked and closed position.
Figure 7:
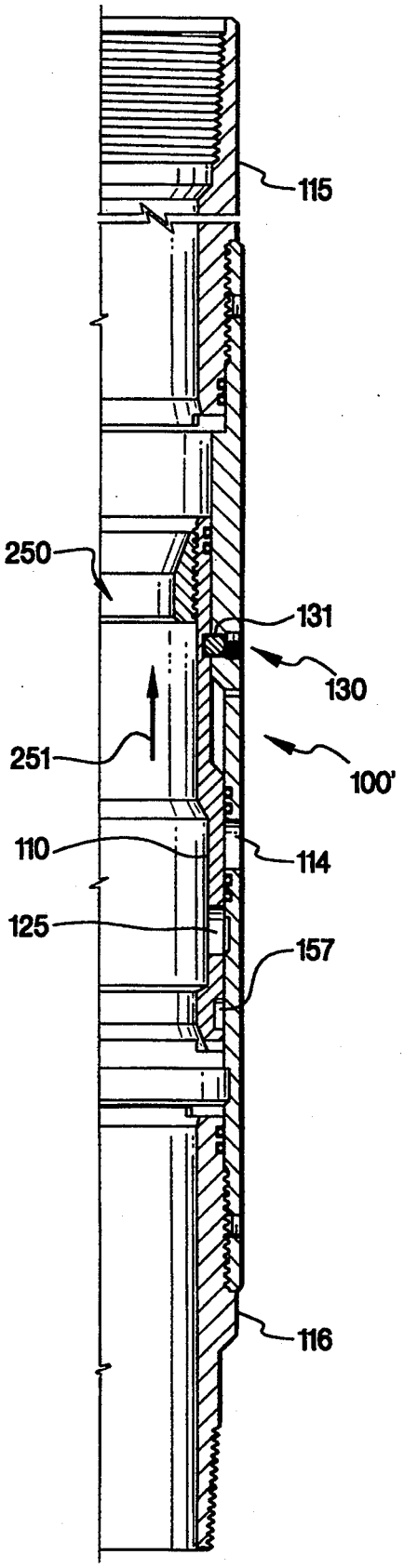
FIG. 7 is a partial cross-sectional view of a modification of the port collar of FIGS. 1–3, in accordance with the present invention, the port collar being illustrated in its first, closed position.
Figure 8:
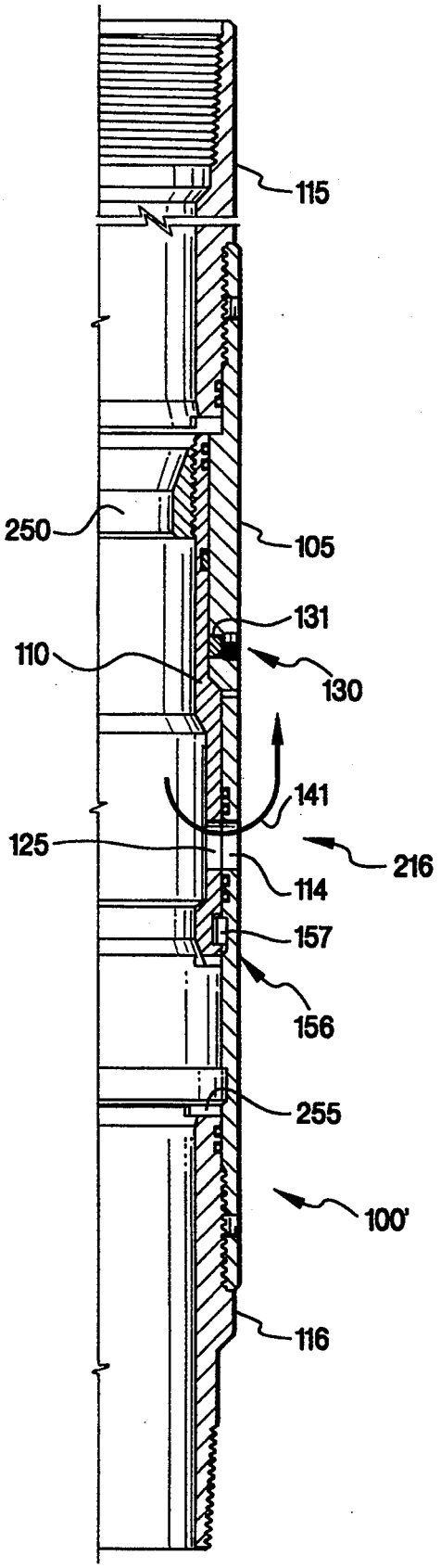
FIG. 8 is a partial cross-sectional view of the port collar FIG. 8 in its second, open position.

With reference to FIGS. 7-9, another method for cementing a casing string utilizing the port collar 100 of the present invention is illustrated. Port collar 100' is identical to port collar 100 previously described, with the exception that: an aluminum annular ring 250 is disposed within sleeve 110, as by threading it into sleeve 110; and port collar 100 is rotated 180°, or placed upside down, before attaching it to top sub 115 and bottom sub 116. With the exception of the installation of aluminum ring 250, the construction of port collar 100' is identical to the construction of port collar 100 previously described. In FIG. 7, sleeve 110 is in its first closed position, corresponding to that position previously described in connection with FIG. 1. Upon the application of the first predetermined hydraulic force upon sleeve 110, shear balls 131 of first releasable securing means 130 are sheared, and sleeve 110 moves in a first longitudinal direction as shown by arrows 251 until sleeve 110 is disposed in the second, fluid transmitting position illustrated in FIG. 8, which corresponds to the second position previously described in connection with FIG. 2. The first predetermined hydraulic force can be applied to sleeve 110 by pumping drilling mud into port collar 100' until the pressure force acting upon the differential piston area of sleeve 110.causes the shearing of shear balls 131. Cement may then be pumped down casing string 101 until it exits through the first fluid communication passageway 216 formed by mating fluid ports 125, 114 in the direction of arrow 141. After the desired amount of cement to be pumped is in casing string 101, a conventional rubber closing plug 252 is placed in the casing string 101 and pumped downwardly With drilling mud until rubber closure plug 252 is sealed in an abutting relationship against the aluminum annular ring 250 as shown in FIG. 9. Further pumping of drilling mud into casing string 101 applies the second predetermined force upon sleeve 110 by way of aluminum ring 250 to cause the compression of snap ring 157. Second releasable shearing means 156 is then released and sleeve 110 moves downwardly in a second direction as shown by arrow 253 until snap ring 157 seats in the locking means 151 in the manner previously described, in connection with FIG. 3. Sleeve 110 is provided with at least one lug 254 which is engageable with a recess 255 formed in bottom sub 116, which prevents sleeve 110 from rotating within barrel 105 when it is necessary to remove rubber closure plug 252 and aluminum annular ring 250, as by drilling them out, in order to gain access to the lower end 103 of casing string 101.

Advantages associated with the port collar 100' of FIGS. 7-9 are that the same tool, or port collar 100, may be utilized in different types of cementing operations, with only a minor modification, that being the insertion of aluminum ring 250. Remote tool stocking points would only need to stock one port collar instead of two, thus reducing inventory costs while maintaining versatility. Additionally, when the port collar 100' is utilized, the sleeve may be moved into its third closed and locked position by merely pumping rubber closure plug 252 downwardly through casing string 101, without the step of lowering the swab cup wash tool 180 and associated pipe string 191.

It is to be understood that the invention is not to be limited to the exact details of construction, operation, exact materials or embodiment shown and described, as obvious modifications and equivalence will be apparent to one skilled in the art; for example, the port collar can be installed in its upside down configuration without an aluminum ring, and the sleeve may be closed by operation of the swab cup wash tool. Additionally, more than one port collar may be used in the same casing string, or the port collars could be used in tapered casing strings having two different diameters. Further, the fluid ports of the barrel of the port collar could be disposed at an angle with respect to the longitudinal axis of the port collar. Accordingly, the invention is therefore to be limited only by the scope of the appended claims.

We claim:

1. A port collar, for cementing a casing string having an upper and a lower end within a well bore, comprising;

an outer, generally tubular-shaped barrel having an inner and an outer surface with at least one fluid port disposed between and through the inner and outer surfaces of the barrel;

means for connecting the barrel to the casing string at a location intermediate the upper and lower ends of the casing string;

a movable, generally tubular shaped sleeve, having an inner bore and an outer surface, disposed within the barrel with the outer surface of the sleeve in a sealed relationship with the inner surface of the barrel, the sleeve having at least one fluid port extending between and through the inner bore and outer surface of the sleeve, and the inner bore of the sleeve includes a means for receiving a port collar engaging means;

a first means for releasably securing the sleeve within the barrel in a first position with the at least one fluid ports of the barrel and sleeve being longitudinally spaced from each other, whereby cement may not pass from the inner bore of the sleeve through the at least one fluid port of the barrel, the first releasable securing means requiring an application of a first predetermined hydraulic force upon the sleeve to release the sleeve and permit the sleeve to move in a first direction, longitudinally with respect to the barrel to a second position with the at least one fluid ports of the sleeve and the barrel in a mating, fluid communication relationship, whereby cement may pass from the inner bore of the sleeve and through the fluid ports into the well bore;

the sleeve requiring an application of a second predetermined force from the port collar engaging means, which is less than the first predetermined force, to move the sleeve and permit the sleeve to move in a second direction, opposite from the first direction of sleeve movement, longitudinally with respect to the barrel; and means for locking the sleeve within the barrel in a third position with the at least one fluid ports of the barrel and sleeve being longitudinally spaced from each other, whereby cement may not pass from the inner bore of the sleeve through the at least one fluid port of the barrel.

2. The port collar of claim 1, wherein a first portion of the outer surface of the sleeve has a first diameter and a second portion of the outer surface of the sleeve has a second diameter, the first diameter being greater than the second diameter; and a first portion of the inner surface of the barrel has a first diameter, substantially corresponding in size to the first diameter of the sleeve, and a second portion of the inner surface of the barrel has a second diameter substantially corresponding in size to the second diameter of the sleeve, whereby upon the application of the first predetermined hydraulic force upon the sleeve, the sleeve will move in a longitudinal direction with respect to the barrel toward the smaller diameter of the sleeve and barrel.

3. The port collar of claim 1, wherein the first releasable securing means is a plurality of metallic balls disposed in a first mating groove defined by a first annular groove formed in the outer surface of the sleeve and a first annular groove formed in the inner surface of the barrel.

4. The port collar of claim 3, and the first annular grooves of the sleeve and barrel are disposed on a reduced diameter portion of the sleeve and barrel.

5. The port collar of claim 1, including a second means for releasably securing the sleeve within the barrel in the second position, the second predetermined force acting upon the sleeve to release the sleeve and permit the sleeve to move in the second direction; and the second releasable securing means is a snap ring disposed in a second mating groove defined by a second annular groove formed in the outer surface of the sleeve and a second annular groove formed in the inner surface of the barrel.

6. The port collar of claim 5, wherein the second annular grooves are disposed on an enlarged diameter portion of the sleeve and barrel.

7. The port collar of claim 6, wherein the locking means is the snap ring disposed in a third mating groove defined by the second annular groove formed in the outer surface of the sleeve and a third annular groove formed in the inner surface of the barrel.

8. The port collar of claim 7, wherein the second annular groove of the sleeve and the third annular groove of the barrel are disposed on an enlarged diameter portion of the sleeve and barrel.

9. The port collar of claim 1, wherein the receiving means is an annular groove formed in the inner bore of the sleeve which substantially mates with the port collar engaging means.

10. The port collar of claim 9, wherein the annular groove has first and second end wall surfaces, each end wall surface disposed at an angle with respect to the inner bore of the sleeve, and the angle of the first end wall surface is different from the angle of the second end wall surface.

11. A cementing apparatus for cementing a casing string having an upper and a lower end within a well bore, comprising;

an outer, generally tubular-shaped barrel having an inner and an outer surface with at least one fluid port disposed between and through the inner and outer surfaces of the barrel;

means for connecting the barrel to the casing string at a location intermediate the upper and lower ends of the casing string;

a movable, generally tubular shaped sleeve, having an inner bore and an outer surface, disposed within the barrel with the outer surface of the sleeve in a sealed relationship with the inner surface of the barrel, the sleeve having at least one fluid port extending between and through the inner bore and outer surface of the sleeve;

a first means for releasably securing the sleeve within the barrel in a first position with the at least one fluid ports of the barrel and sleeve being longitudinally spaced from each other, whereby cement may not pass from the inner bore of the sleeve through the at least one fluid port of the barrel, the first releasable securing means requiring an application of a first predetermined hydraulic force upon the sleeve to release the sleeve and permit the sleeve to move in a first direction, longitudinally with respect to the barrel to a second position with the at least one fluid ports of the sleeve and the barrel in a mating, fluid communication relationship, whereby cement may pass from the inner bore of the sleeve and through the fluid ports into the well bore;

the sleeve requiring an application of a second predetermined force, which is less than the first predetermined force, to move the sleeve and permit the sleeve to move in a second direction, opposite from the first direction of sleeve movement, longitudinally with respect to the barrel;

means for locking the sleeve within the barrel in a third position with the at least one fluid ports of the barrel and sleeve being longitudinally spaced from each other, whereby cement may not pass from the inner bore of the sleeve through the at least one fluid port of the barrel; and a swab cup wash tool having a port collar engaging means and a plurality of longitudinally spaced swab cups for sealing engagement with the inner bore of the port collar when the sleeve is in the second position, the port collar engaging means cooperating with the inner bore of the sleeve to apply the second predetermined force to move the sleeve.

12. The cementing apparatus of claim 11, wherein the port collar engaging means is a collet locator.

13. The cementing apparatus of claim 11, wherein a first portion of the outer surface of the sleeve has a first diameter and a second portion of the outer surface of the sleeve has a second diameter, the first diameter being greater than the second diameter; and a first portion of the inner surface of the barrel has a first diameter, substantially corresponding in size to the first diameter of the sleeve, and a second portion of the inner surface of the barrel has a second diameter substantially corresponding in size to the second diameter of the sleeve, whereby upon the application of the first predetermined hydraulic force upon the sleeve, the sleeve will move in a longitudinal direction with respect to the barrel toward the smaller diameter of the sleeve and barrel.

14. The cementing apparatus of claim 11, wherein the first releasable securing means is a plurality of metallic balls disposed in a first mating groove defined by a first annular groove formed in the outer surface of the sleeve and a first annular groove formed in the inner surface of the barrel.

15. The cementing apparatus of claim 14, wherein the first annular grooves of the sleeve and barrel are disposed on a reduced diameter portion of the sleeve and barrel.

16. The cementing apparatus of claim 11, including a second means for releasably securing the sleeve within the barrel in the second position, the second predetermined force acting upon the sleeve to release the sleeve and permit the sleeve to move in the second direction; and the second releasable securing means is a snap ring disposed in a second mating groove defined by a second annular groove formed in the outer surface of the sleeve and a second annular groove formed in the inner surface of the barrel.

17. The cementing apparatus of claim 16, wherein the second annular grooves are disposed on an enlarged diameter portion of the sleeve and barrel.

18. The cementing apparatus of claim 16, wherein the locking means is the snap ring disposed in a third mating groove defined by the second annular groove formed in the outer surface of the sleeve and a third annular groove formed in the inner surface of the barrel.

19. The cementing apparatus of claim 18, wherein the second annular groove of the sleeve and the third annular groove of the barrel are disposed on an enlarged diameter portion of the sleeve and barrel.

20. The cementing apparatus of claim 11, wherein the inner bore of the sleeve includes a means for receiving the port collar engaging means swab cup wash tool which applies the second predetermined force to move the sleeve into the third position.

21. The cementing apparatus of claim 20, wherein the receiving means is an annular groove formed in the inner bore of the sleeve which substantially mates with the port collar engaging means of the swab cup wash tool.

22. The cementing apparatus of claim 21, wherein the annular groove first and second end wall surfaces, each end wall surface disposed at an angle with respect to the inner bore of the sleeve, and the angle of the first end wall surface is different from the angle of the second end wall surface.

23. A port collar, for cementing a casing string having an upper and a lower end within a well bore, comprising;

an outer, generally tubular-shaped barrel having an inner and an outer surface with at least one fluid port disposed between and through the inner and outer surfaces of the barrel;

means for connecting the barrel to the casing string at a location intermediate the upper and lower ends of the casing string;

a movable, generally tubular shaped sleeve, having an inner bore and an outer surface, disposed within the barrel with the outer surface of the sleeve in a sealed relationship with the inner surface of the barrel, the sleeve having at least one fluid port extending between and through the inner bore and outer surface of the sleeve;

a first means for releasably securing the sleeve within the barrel in a first position with the at least one fluid ports of the barrel and sleeve being longitudinally spaced from each other, whereby cement may not pass from the inner bore of the sleeve through the at least one fluid port of the barrel, the first releasable securing means requiring an application of a first predetermined hydraulic force upon the sleeve to release the sleeve and permit the sleeve to move in a first direction, longitudinally with respect to the barrel to a second position with the at least one fluid ports of the sleeve and the barrel in a mating, fluid communication relationship, whereby cement may pass from the inner bore of the sleeve and through the fluid ports into the well bore;

the sleeve requiring an application of a second predetermined force, which is less than the first predetermined force, to move the sleeve and permit the sleeve to move in a second direction, opposite from the first direction of sleeve movement, longitudinally with respect to the barrel; and means for locking the sleeve within the barrel in a third position with the at least one fluid ports of the barrel and sleeve being longitudinally spaced from each other, the at least one fluid port of the sleeve being disposed in substantially the same spaced relationship from the at least one fluid port of the barrel in the first and third positions, whereby cement may not pass from the inner bore of the sleeve through the at least one fluid port of the barrel.

24. The port collar of claim 23, wherein a first portion of the outer surface of the sleeve has a first diameter and a second portion of the outer surface of the sleeve has a second diameter, the first diameter being greater than the second diameter; and a first portion of the inner surface of the barrel has a first diameter, substantially corresponding in size to the first diameter of the sleeve, and a second portion of the inner surface of the barrel has a second diameter substantially corresponding in size to the second diameter of the sleeve, whereby upon the application of the first predetermined hydraulic force upon the sleeve, the sleeve will move in a longitudinal direction with respect to the barrel toward the smaller diameter of the sleeve and barrel.

25. The port collar of claim 23, wherein the first releasable securing means is a plurality of metallic balls disposed in a first mating groove defined by a first annular groove formed in the outer surface of the sleeve and a first annular groove formed in the inner surface of the barrel.

26. The port collar of claim 25, and the first annular grooves of the sleeve and barrel are disposed on a reduced diameter portion of the sleeve and barrel.

27. The port collar of claim 23, including a second means for releasably securing the sleeve within the barrel in the second position, the second predetermined force acting upon the sleeve to release the sleeve and permit the sleeve to move in the second direction; and the second releasable securing means is a snap ring disposed in a second mating groove defined by a second annular groove formed in the outer surface of the sleeve and a second annular groove formed in the inner surface of the barrel.

28. The port collar of claim 27, wherein the second annular grooves are disposed on an enlarged diameter portion of the sleeve and barrel.

29. The port collar of claim 27, wherein the locking means is the snap ring disposed in a third mating groove defined by the second annular groove formed in the outer surface of the sleeve and a third annular groove formed in the inner surface of the barrel.

30. The port collar of claim 29, wherein the second annular groove of the sleeve and the third annular groove of the barrel are disposed on an enlarged diameter portion of the sleeve and barrel.

31. The port collar of claim 23, wherein the inner bore of the sleeve includes a means for receiving a port collar engaging means which applies the second predetermined force to move the sleeve into the third position.

32. The port collar of claim 31, wherein the receiving means is an annular groove formed in the inner bore of the sleeve which substantially mates with the port collar engaging means.

33. The port collar of claim 32, wherein the annular groove has first and second end wall surfaces, each end wall surface disposed at an angle with respect to the inner bore of the sleeve, and the angle of the first end wall surface is different from the angle of the second end wall surface.

* * * * *